US011420251B2

(12) United States Patent
Bachmayer et al.

(10) Patent No.: US 11,420,251 B2
(45) Date of Patent: Aug. 23, 2022

(54) CASTING MOLD AND PROCESS FOR MANUFACTURING A CRANKCASE

(71) Applicant: Bayerische Motoren Werke Aktiengesellschaft, Munich (DE)

(72) Inventors: Michael Bachmayer, Altfraunhofen (DE); Andreas Sachsenhauser, Ergolding (DE); Stefan Schmidberger, Straubing (DE); Thomas Schwabl, Hohenthann (DE)

(73) Assignee: Bayerische Motoren Werke Aktiengesellscaft, Munich (DE)

( * ) Notice: Subject to any disclaimer, the term of this patent is extended or adjusted under 35 U.S.C. 154(b) by 58 days.

(21) Appl. No.: 16/777,076

(22) Filed: Jan. 30, 2020

(65) Prior Publication Data

US 2020/0164428 A1 May 28, 2020

Related U.S. Application Data

(63) Continuation of application No. PCT/EP2018/069227, filed on Jul. 16, 2018.

(30) Foreign Application Priority Data

Aug. 4, 2017 (DE) ..... 10 2017 213 542.5

(51) Int. Cl.

| | |
|---|---|
| ***B22C 9/10*** | (2006.01) |
| ***B22C 9/22*** | (2006.01) |
| ***B22D 15/02*** | (2006.01) |
| ***B22C 9/06*** | (2006.01) |

(52) U.S. Cl.
CPC ..... *B22C 9/103* (2013.01); *B22C 9/065* (2013.01); *B22C 9/22* (2013.01); *B22D 15/02* (2013.01); *B22C 9/101* (2013.01)

(58) Field of Classification Search
CPC ..... B22C 9/10; B22C 9/103; B22C 9/108; B22C 9/22; B22C 9/24; B22D 15/02
See application file for complete search history.

(56) References Cited

U.S. PATENT DOCUMENTS

| | | | | |
|---|---|---|---|---|
| 4,917,169 | A | 4/1990 | Melde-Tuczai et al. | |
| 9,211,584 | B2 * | 12/2015 | Shibata | B22C 9/10 |
| 2002/0121250 | A1 | 9/2002 | Shimizu et al. | |

(Continued)

FOREIGN PATENT DOCUMENTS

| | | | |
|---|---|---|---|
| CN | 1374446 | A | 10/2002 |
| CN | 103586418 | A | 2/2014 |

(Continued)

OTHER PUBLICATIONS

PCT/EP2018/069227, Interational Search Report dated Sep. 17, 2018 (Two (2) Pages.

(Continued)

*Primary Examiner* — Kevin E Yoon
(74) *Attorney, Agent, or Firm* — Crowell & Moring LLP

(57) ABSTRACT

A casting mold for a crankcase of an internal combustion engine includes a water jacket core which has a frame core and a cooling duct core. A land core is provided which is designed and positioned in such a way as to form a cooling duct in an inter-cylinder land of a crankcase. The land core is retained in the frame core and is, or can be, centered using a top core.

10 Claims, 3 Drawing Sheets

(56) References Cited

U.S. PATENT DOCUMENTS

| | | | | |
|---|---|---|---|---|
| 2017/0167435 | A1* | 6/2017 | Wang | B23K 20/1215 |
| 2017/0173670 | A1* | 6/2017 | Diel | B22C 1/22 |

FOREIGN PATENT DOCUMENTS

| | | | | | |
|---|---|---|---|---|---|
| CN | 104028700 | A | | 9/2014 | |
| DE | 38 28 093 | A1 | | 3/1989 | |
| DE | 10 2011 105 388 | A1 | | 12/2012 | |
| DE | 10 2012 019 192 | A1 | | 3/2013 | |
| DE | 10 2012 101 893 | A1 | | 9/2013 | |
| DE | 10 2014 101 080 | B3 | | 7/2015 | |
| DE | 10 2015 012 554 | A1 | | 3/2017 | |
| EP | 1 147 836 | A2 | | 10/2001 | |
| EP | 0 974 414 81 | | | 4/2005 | |
| GB | 2352418 | A | * | 1/2001 | F02F 1/108 |
| JP | 10024347 | A | * | 1/1998 | B22C 9/10 |

OTHER PUBLICATIONS

German Search Report issued in German counterpart application No. 10 2017 213 542.5 dated Jun. 6, 2018, with Statement of Relevancy (Eight (8) pages).

Chinese Office Action issued in Chinese application No. 201880035648.9 dated Jul. 16, 2020 (Seven (7) pages).

* cited by examiner

CASTING MOLD AND PROCESS FOR MANUFACTURING A CRANKCASE

CROSS REFERENCE TO RELATED APPLICATIONS

This application is a continuation of PCT International Application No. PCT/EP2018/069227, filed Jul. 16, 2018, which claims priority under 35 U.S.C. § 119 from German Patent Application No. 10 2017 213 542.5, filed Aug. 4, 2017, the entire disclosures of which are herein expressly incorporated by reference.

BACKGROUND AND SUMMARY OF THE INVENTION

The present invention relates to a casting mold for a crankcase of an internal combustion engine, a process for manufacturing a crankcase as well as a use of a casting mold.

The mechanical and thermal loads of internal combustion engines are continually increasing due to higher power densities. In this connection, it is known to cool the inter-cylinder lands of crankcases, wherein the cooling ducts are often bored after the crankcase has been cast. However, this is time-consuming, costly and exceptionally inflexible as regards the geometry of the cooling ducts. In addition, it is also known to make allowance for possible cooling ducts in the lands even when casting the crankcase, by using corresponding land cooling cores. In this case, however, the positioning of the cores has proved to be particularly problematical. This positioning has to be carried out in an exceptionally reliable and accurate manner, since the extremely thin-walled lands between the cylinders only permit minimal tolerances.

It is, therefore, the object of the present invention to provide a casting mold for a crankcase, a process for manufacturing a crankcase and a use of a casting mold, which remedy the aforementioned drawbacks and at the same time, in particular, permit a casting of land cooling systems which is exceptionally reliable and safe in terms of the process thereof.

According to the invention, a casting mold for a crankcase of an internal combustion engine comprises a water jacket core, wherein the water jacket core has a frame core and a cooling-duct core and wherein at least one land core is provided, the land core being designed and positioned in such a way as to form a cooling duct in an inter-cylinder land of a crankcase, and wherein the at least one land core is retained in the frame core and is or can be centered using an upper core and/or a top core. In particular, the top core or cover core is a core which terminates the crankcase at the top and, for example, forms the top cover. Advantageously, the land core is pre-centered or pre-positioned by the frame core of the water jacket core. The actual final centering takes place, therefore, via the top core. The land core is thus preferably initially inserted into the frame core of the water jacket and in this case simply pre-centered. When the casting mold is closed, wherein according to a preferred embodiment the casting mold is preferably configured as a permanent mold, the final centering of the land core is then carried out, in particular via centering surfaces in the top core.

Preferably, the casting mold is designed such that the water jacket core is (chronologically speaking) centered before the land core. Advantageously, when closing the casting mold and/or in particular the permanent mold, initially the water jacket is centered and then the land core, preferably both via corresponding centering surfaces in the top core.

Preferably, the land core has at least one cooling duct portion which is positioned and/or retained via a plurality of, in particular separate, retaining surfaces in and/or on and/or against the frame core. In other words, the land core is retained via a plurality of (separate) retaining surfaces in and/or on and/or against the frame core. Preferably, the retaining surfaces are oriented perpendicular and/or substantially perpendicular to the cylinder axes of the crankcase. As the land core is initially only positioned on the frame core of the water jacket core, strain or incipient cracks in the core may be avoided. The at least one cooling duct portion is the region of the land core which forms the actual cooling duct and/or a plurality thereof in the land of the crankcase. According to preferred embodiments, by means of the separate retaining surfaces, for example, a three-point or four-point bearing of the land core may be implemented in the frame core and/or generally in the water jacket core. According to one embodiment, all of the bearing points are located outside the subsequent cast part.

According to one embodiment, the retaining surfaces are configured and/or arranged so as to be offset relative to the cooling duct portion, viewed in a longitudinal direction of the crankcase. In other words, the at least one cooling duct portion is arranged substantially centrally relative to the retaining surfaces, which is advantageous for the stability and the ability to position the land core accurately.

According to one embodiment, the retaining surfaces are shaped so as to be rectangular and/or substantially rectangular and/or also round, in particular circular, or oval and, in particular relative to the longitudinal direction, are oriented in pairs in the longitudinal direction and/or transversely thereto. This is particularly advantageous since by this configuration a plurality of land cores may be arranged in succession in a space-saving manner. At this point it should be mentioned that it has to be emphasized as a further advantage that a separate land core is provided for each land of the crankcase. As a result, it is possible to center each core individually, whereby amongst other things the effect of shrinkage may be minimized.

According to one embodiment, a plurality of cooling portions, for example two, three, four or more, are arranged on top of one another. A cross section of the cooling duct portion(s) is preferably substantially rectangular or lenticular and/or oval but may also be configured to be round, in particular circular, or angular, optionally also polygonal. The exact geometry is, in particular, dependent on the available wall thicknesses of the land and/or the desired flow conditions in the respective cooling portion. In addition, the cooling duct portions may differ geometrically, both with regard to their shape and also with regard to their size.

Preferably, the land core has a plurality of arrangement portions which extend away from the at least one cooling duct portion and which have the retaining surfaces on the end face. The land core thus advantageously has a supporting structure which is produced via the arrangement portions and an actual land cooling contour which is produced via the at least one cooling duct portion. In this case, the arrangement portions are configured to be significantly thicker compared to the at least one cooling duct portion, and thus provide stability to the land cooling contour which is exceptionally sensitive per se, produced by the at least one cooling duct portion.

Preferably, the arrangement portions are configured so as to be land-shaped and, in particular, to follow a cylindrical contour. Expediently, the arrangement portions are formed to be at least partially arcuate and/or circular arc-shaped (viewed along the cylinder axis). Advantageously, therefore, free space may be provided for the arrangement of cylinder pins and any precast tie rods, which are preferably a component of the top core.

According to one embodiment, the land core has at least one support element for increasing the stability. Expediently, the support element is configured and/or arranged such that it connects one or more arrangement portions.

According to one embodiment, the support element is arranged above the at least one cooling duct portion. Expediently, the support element is also accordingly positioned outside the subsequent cast part.

According to a preferred embodiment, the at least one support element is configured as a core bearing and/or core print. Preferably, the final centering of the land core, therefore, takes place via the support element and/or via the top core and the support element.

Alternatively (or additionally) on the end face the arrangement portions have core bearings for the top core and/or configure or form these core bearings. In other words, the end portions are configured on the end face such that the centering is carried out and/or may be carried out via suitable centering surfaces of the top core.

According to one embodiment, at least one retaining surface is configured on a cooling portion. The retaining surface on the cooling duct portion is designed to be arranged and/or to bear directly against the cooling duct core of the water jacket core. According to one embodiment, the land core has two arrangement portions which have the retaining surfaces on the end face, wherein a third retaining surface is provided directly on the cooling duct portion for bearing against the cooling-duct core of the water jacket core. Thus a three-point bearing which is configured to be exceptionally narrow and space-saving is produced and, at the same time, an optimal alignment is permitted with the smallest tolerances due to the support via three points. In this embodiment the land cooling system and the water jacket of the crankcase are connected directly together.

According to one embodiment, the aforementioned retaining surface (on the cooling duct portion) is configured as a front and/or rear projection. Expediently, therefore, a positive connection acts between the retaining surface and the water jacket. A retaining surface which is configured as a front projection advantageously engages in a rear projection in the water jacket and/or vice versa, whereby advantageously very accurate (pre) centering may be achieved. Expediently, therefore, a corresponding front and/or rear projection is formed on the point corresponding to the aforementioned retaining surface on/in the water jacket.

Alternatively, in particular in the aforementioned embodiments, the cooling duct portion and/or the cooling duct portion arranged furthest to the bottom is spaced apart from the cooling-duct core of the water jacket and thus from the subsequent water jacket. If desired, however, a through-passage may also be subsequently machined here, for example by means of a bore. By the separate bearing and/or the aforementioned spacing advantageously resilience/flash between the cores may be eliminated.

According to one embodiment, the arrangement portions have on the end face vertical retaining surfaces which firstly serve for the aforementioned centering via the top core but also for the pre-centering in the frame core of the water jacket core.

According to one embodiment, the core shooters are provided on the arrangement portions. This is particularly advantageous since, as already mentioned, the arrangement portions are dimensioned to be significantly larger than the generally very thin cooling duct portions. According to one embodiment, the core shooters are provided on all arrangement portions, for example on all four arrangement portions, i.e., the regions in which the core and/or the cores is/are filled via the shooting nozzle.

According to one embodiment, the land core is produced from a molding sand which comprises inorganic binders and/or an inorganic binder. Instead of conventional organic binding agents, preferably a particularly environmentally friendly inorganic binding system is used. This binding agent releases virtually no environmentally harmful emissions and at the same time permits the manufacture of complex sand cores. For example, water glass-based silicate binders which are very similar to quartz sand in terms of their chemical structure are used. The hardening of the core is carried out via a polycondensation reaction in which water is separated off. The core sand only has to be dried by the hot core shooting tool and hot air flushing. Advantageously, the land core consists entirely of molding material and/or molding sand or core sand, and thus has no further metal inserts, etc. for example for stabilizing.

The invention further relates to a process for manufacturing a crankcase of an internal combustion engine, comprising the steps:

providing a casting mold with a water jacket core, wherein the water jacket core has a frame core and a cooling duct core;

arranging a land core on the frame core; and centering the water jacket core and then centering the land core, in particular via a top core.

Expediently, the land core is shot separately and inserted and pre-centered in the frame core of the water jacket. When shooting the permanent mold, firstly the water jacket is accurately centered and then the land core, preferably both via corresponding centering surfaces in the top core.

The invention further relates to a use of a casting mold according to the invention or a process according to the invention when manufacturing internal combustion engines.

For the process according to the invention and for the use according to the invention, the advantages and features mentioned in connection with the casting mold apply in a similar and corresponding manner as well as vice versa and relative to one another.

Further advantages and features are disclosed by means of the following description of preferred embodiments of casting molds and/or land cores with reference to the accompanying figures.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
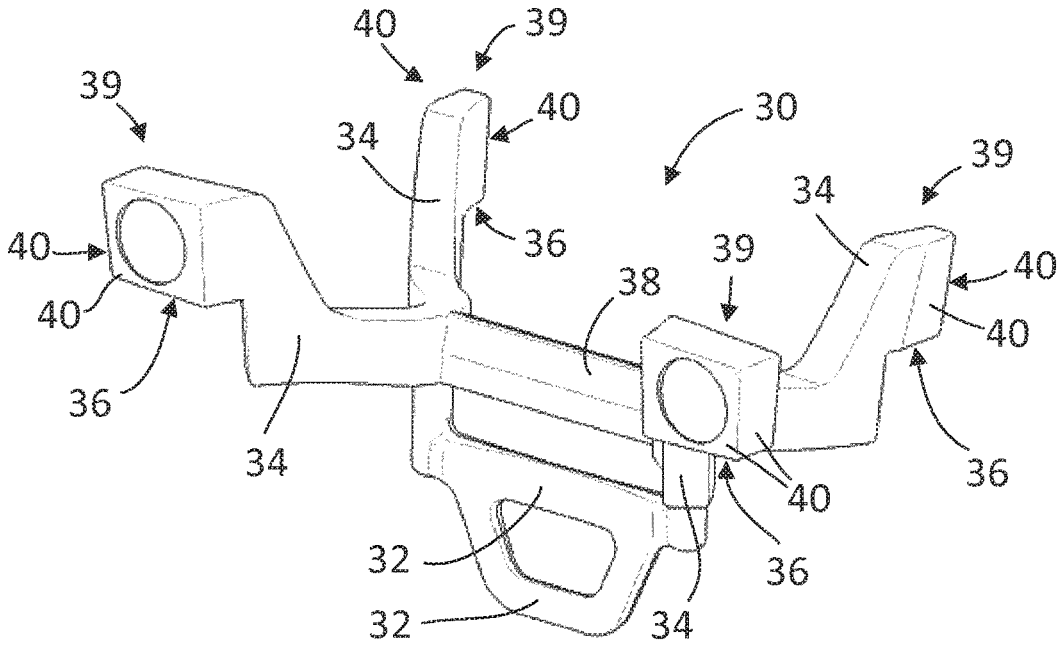
FIG. 1 shows a perspective view of an embodiment of a land core.

FIG. 1 shows in a perspective view a land core 30 which in its central region has two cooling duct portions 32 which are connected together. A total of four arrangement portions 34 extend away therefrom, wherein these arrangement portions have retaining surfaces 36 on the end face which are designed to bear and/or arrange the land core 30 on a frame core, not shown here, of a water jacket core. A support element 38 is provided between the arrangement portions 34 and/or above the cooling duct portions 32, in particular for reinforcing and/or stabilizing the entire land core 30. In addition to the retaining surfaces 36, on the end face the arrangement portions 34 have vertical arrangement surfaces 40 which amongst other things serve for pre-centering the land core in the frame core of the water jacket core. In addition, the arrangement portions 34 are configured on the end face such that a centering of the land core 30 is possible via a further core, not shown here, for example a top core or cover core. In other words, the arrangement portions on the end face form core bearings and/or core prints 39 which are provided for centering in corresponding core prints, for example of a top core. Alternatively and/or additionally, the support element 38 preferably serves as a core bearing and/or core print.

Figure 2:
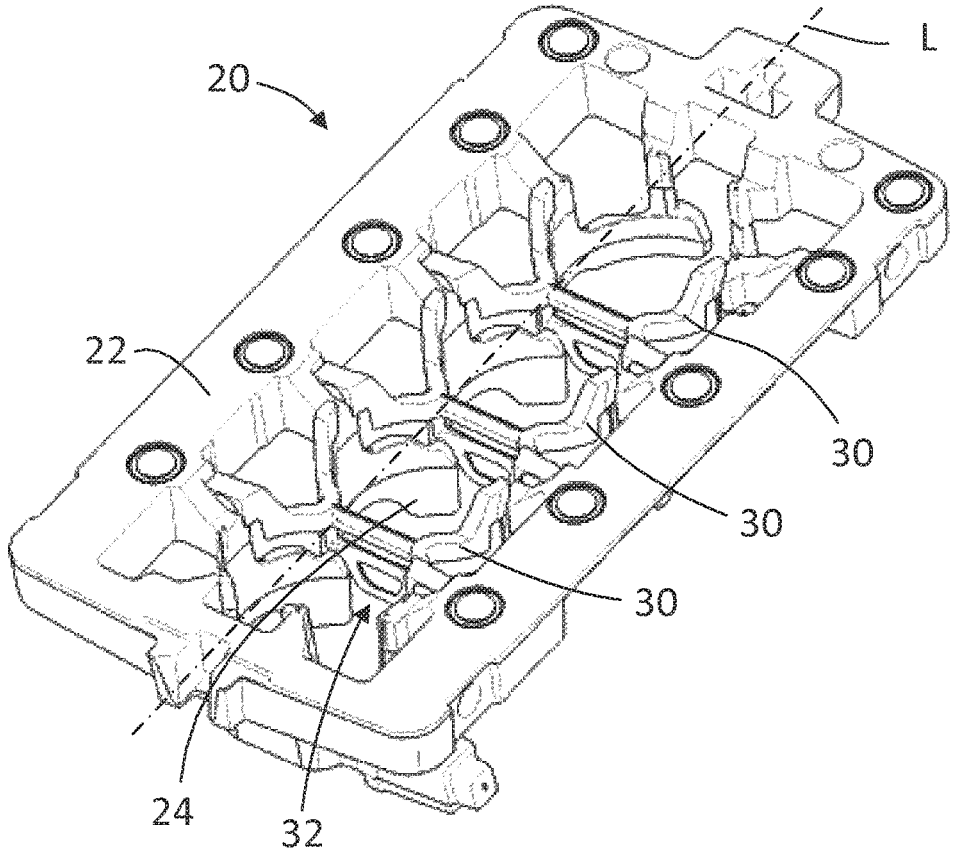
FIG. 2 shows a perspective view of a water jacket core, in addition to a plurality of land cores.

FIG. 2 shows in a perspective view a water jacket core 20 which extends along a longitudinal axis L and which has a frame core 22 and a cooling duct core 24. The cooling duct core 24 is that region and/or portion of the water jacket core 20 which forms the actual "water jacket" in the finished crankcase. The four cylinder openings may be identified clearly, wherein in each case a land core 30 is arranged and/or provided between these cylinder openings, i.e., in the lands of the subsequent cylinder. The reference numeral 32 refers to the cooling duct portions of the land cores 30. Moreover, the embodiment of the land cores 30 shown here corresponds to that disclosed in FIG. 1 so that reference is made thereto. It should also be mentioned that the shape of the land cores 30 permits a simple insertion or positioning in the frame core 22 of the water jacket core 20, in particular by the alignment of the retaining surfaces and/or (vertical) arrangement surfaces, see FIG. 1. The arrangement portions follow the cylindrical contour. Along the longitudinal axis L of the water jacket core 20 the retaining surfaces of the land core 30 are offset relative to the cooling duct portion 32 and/or to the cooling duct portions 32, whereby the cooling duct portions 32 are arranged approximately centrally between the retaining surfaces of the arrangement portions. As a result, an exceptionally stable land core 30 is produced, the land core additionally being able to be positioned exceptionally accurately.

Figure 3:
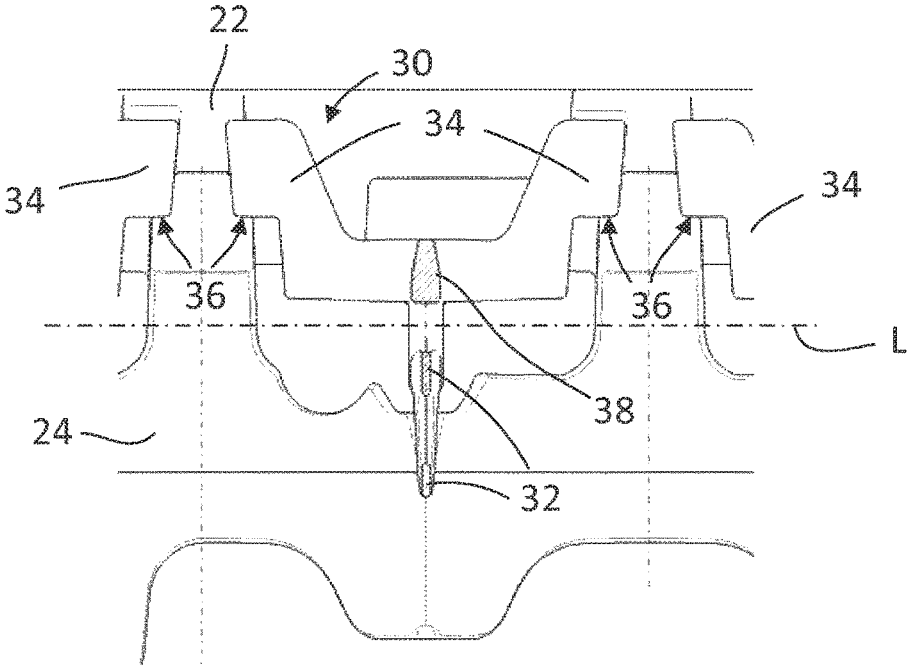
FIG. 3 shows a sectional view of a water jacket core in which a plurality of land cores are arranged.

FIG. 3 now shows a sectional view of the water jacket core disclosed in FIG. 2, along the longitudinal axis L. In particular, the frame core 22 and the actual cooling-duct core 24 of the water jacket core may be identified. A total of three land cores 30 may be identified, wherein the respective arrangement portions 34 of the two outer land cores are only partially shown. The arrangement portions 34 in each case have retaining surfaces 36, whereby they are supported and/or bear against the frame core 22 of the water jacket core. In particular, the very thin cooling portions 32 which form the subsequent land cooling ducts may be identified. A support element 38 denoted by the reference numeral 38 is arranged thereabove, the support element significantly increasing the stability of the entire arrangement and advantageously serving as a core bearing and/or core print.

Figure 4:
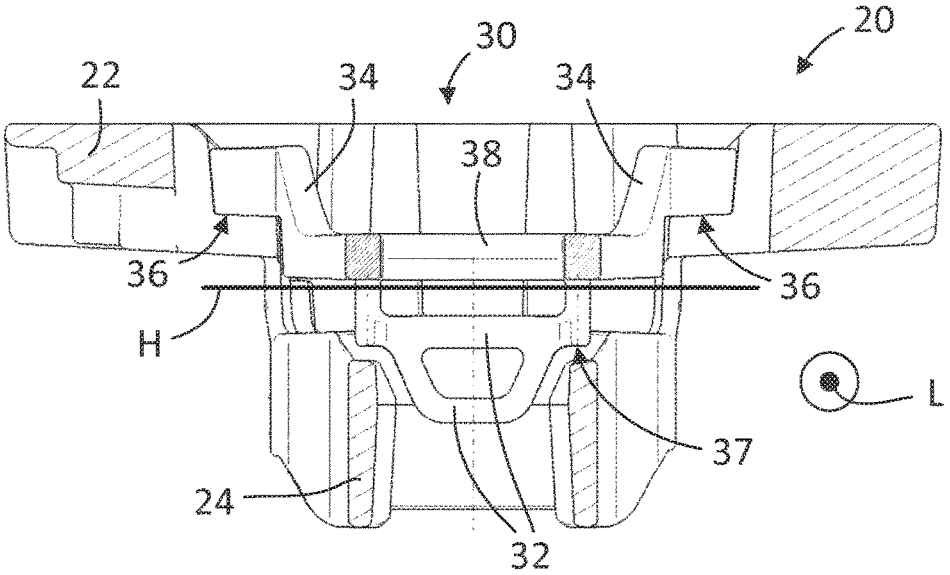
FIG. 4 shows a further sectional view of the water jacket core of FIG. 3.

FIG. 4 shows a further sectional view transversely to the longitudinal axis L, wherein once again the cooling portions 32 of the land core 30 and/or the spacing thereof from the cooling-duct core 24 of the water jacket core 20 may be identified. Moreover, in this view the path of the supporting element 38 and/or the arrangement portions 34 with the retaining surfaces 36 thereof configured on the end face may be identified. The component height (of the crank housing) is denoted by the reference numeral H. It may be clearly identified that in this connection all bearing points of the land core are located outside of the subsequent cast part.

The possible position of a further retaining surface in an alternative embodiment of a land core is denoted by the reference numeral 37. In this embodiment, for example, only the left-hand arrangement portions might be present, whilst the land core in the right-hand region might be directly supported via the retaining surface 37 on a cooling-duct core of a water jacket core.

Figure 5:
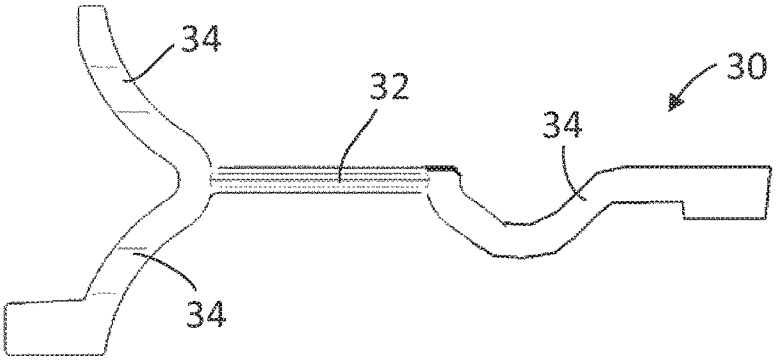
FIG. 5 shows a plan view of a further embodiment of a land core.

FIG. 5 finally shows a further embodiment of a land core 30 in a plan view, comprising two arrangement portions 34 which extend in pairs away from a cooling duct portion 32. A further arrangement portion 34 is configured opposite so that a three-point bearing is produced.

Figure 6:
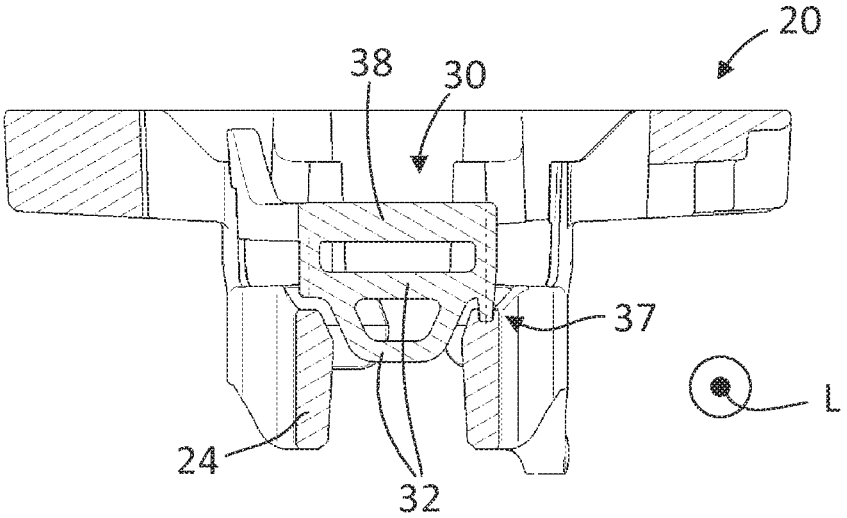
FIG. 6 shows a further embodiment of a land core with a three-point bearing.
Figure 6:
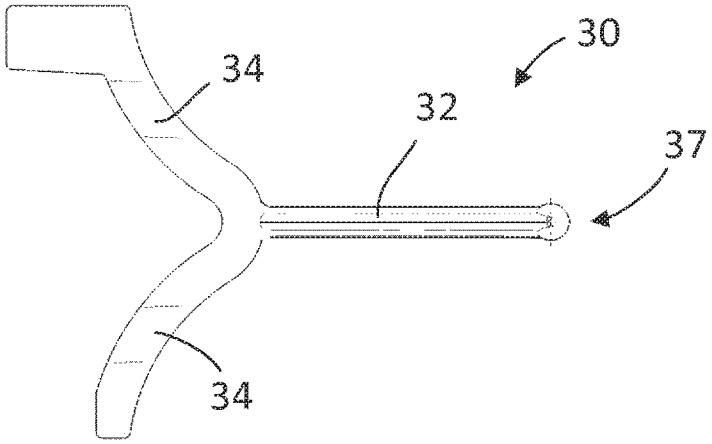

FIG. 6 shows a further embodiment of a land core 30 with a three-point bearing, wherein the arrangement thereof in a water jacket 24 of a water jacket core 20 is shown in the upper image half. The focus in this embodiment is the configuration of a retaining surface 37 as a front projection which engages in a correspondingly configured rear projection in the water jacket 24. The lower view shows a plan view of the land core 30, wherein the very narrow structure thereof is clearly visible. By the positive connection and/or the coupling to the water jacket 24 a very secure arrangement and/or pre-centering is nevertheless implemented. Moreover, the features from the above Figures are disclosed.

LIST OF REFERENCE CHARACTERS

20 Water jacket core
22 Frame core
24 Cooling duct core
30 Land core
32 Cooling duct portion
34 Arrangement portion
36 Retaining surface
37 Retaining surface, front projection
38 Support element
39 Core bearing, core print
40 Vertical arrangement surface
L Longitudinal axis
H Component limit, component height The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A casting mold for a crankcase of an internal combustion engine, comprising:

a water jacket core, wherein the water jacket core has a frame core and a cooling duct core; and a land core, wherein the land core is insertable in the water jacket core to form a cooling duct in an inter-cylinder land of the crankcase;

wherein the land core is retained in the frame core and is centerable using a top core;

wherein the land core has a cooling duct portion and wherein the land core bears via a plurality of retaining surfaces of the land core against or on the frame core;

wherein the plurality of retaining surfaces are oriented perpendicular to a cylinder axis of the crankcase and are offset relative to the cooling duct portion in a longitudinal direction of the water jacket core;

wherein the land core has a plurality of arrangement portions which extend away from the cooling duct portion and wherein the plurality of arrangement portions each have a respective retaining surface on an end face thereof;

wherein the plurality of arrangement portions are land-shaped and follow a cylindrical contour.

2. The casting mold according to claim 1, wherein the water jacket core is centered before the land core when the casting mold is closed.

3. The casting mold according to claim 1, wherein the land core has a plurality of cooling duct portions arranged on top of one another.

4. The casting mold according to claim 1, wherein the land core has a support element for increasing a stability of the land core.

5. The casting mold according to claim 4, wherein the support element is disposed above the cooling duct portion.

6. The casting mold according to claim 4, wherein the support element is configured as a core bearing and/or a core print.

7. The casting mold according to claim 1, wherein a retaining surface is configured on the cooling duct portion.

8. The casting mold according to claim 7, wherein the retaining surface is configured as a front projection and/or a rear projection.

9. The casting mold according to claim 1, wherein a respective core shooter is provided on the plurality of arrangement portions.

10. A process for manufacturing a crankcase of an internal combustion engine, comprising the acts of:

providing a casting mold with a water jacket core, wherein the water jacket core has a frame core and a cooling duct core;

inserting a land core in the frame core; and centering the water jacket core and then centering the land core via a top core;

wherein the land core has a cooling duct portion and wherein the land core bears via a plurality of retaining surfaces of the land core against or on the frame core;

wherein the plurality of retaining surfaces are oriented perpendicular to a cylinder axis of the crankcase and are offset relative to the cooling duct portion in a longitudinal direction of the water jacket core;

wherein the land core has a plurality of arrangement portions which extend away from the cooling duct portion and wherein the plurality of arrangement portions each have a respective retaining surface on an end face thereof;

wherein the plurality of arrangement portions are land-shaped and follow a cylindrical contour.

* * * * *